US010699863B2

(12) United States Patent
Sakuyama et al.

(10) Patent No.: US 10,699,863 B2
(45) Date of Patent: Jun. 30, 2020

(54) GAS CIRCUIT BREAKER

(71) Applicant: Hitachi, Ltd., Tokyo (JP)

(72) Inventors: Toshiaki Sakuyama, Tokyo (JP); Masanao Terada, Tokyo (JP); Hajime Urai, Tokyo (JP); Yuichiro Yamane, Tokyo (JP); Takahiro Nishimura, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 16/275,365

(22) Filed: Feb. 14, 2019

(65) Prior Publication Data

US 2019/0287746 A1 Sep. 19, 2019

(30) Foreign Application Priority Data

Mar. 13, 2018 (JP) ..... 2018-045174

(51) Int. Cl.
*H01H 33/42* (2006.01)
*H01H 33/56* (2006.01)
*H01H 33/70* (2006.01)

(52) U.S. Cl.
CPC ..... *H01H 33/7023* (2013.01); *H01H 33/42* (2013.01); *H01H 33/56* (2013.01)

(58) Field of Classification Search
CPC ..... H01H 33/42; H01H 33/56; H01H 33/55; H01H 33/565; H01H 33/59; H01H 33/596; H01H 33/7023; H01H 33/7038; H01H 33/7046; H01H 33/74; H01H 33/78; H01H 33/90; H01H 33/903; H01H 33/904; H01H 33/95; H01H 2033/902
USPC .. 218/46, 51, 52, 53, 57, 59, 60–63, 68, 72, 218/97
See application file for complete search history.

(56) References Cited

U.S. PATENT DOCUMENTS 8,304,677 B2 * 11/2012 Yoon ..... H01H 33/904 218/14
9,741,514 B2 * 8/2017 Cernat ..... H01H 1/385
2019/0035579 A1 * 1/2019 Pisu ..... H01H 33/7023

FOREIGN PATENT DOCUMENTS

JP 2003-109478 A 4/2003
JP 2012028106 * 9/2012 ..... H01H 33/915
JP 2017134926 * 3/2017 ..... H01H 33/70
WO 2015/039918 A1 3/2015

OTHER PUBLICATIONS

Translation of JP2017134926 (Original doc. published Mar. 8, 2017) (Year: 2017).*
Translation of JP2012028106 (Original doc. published Feb. 9, 2012) (Year: 2012).*
Translation of JP2003109478 (original doc. published Apr. 11, 2003) (Year: 2003).*

* cited by examiner

*Primary Examiner* — William A Bolton
(74) *Attorney, Agent, or Firm* — Mattingly & Malur, PC

(57) ABSTRACT

In order to solve the above-described problems, a gas circuit breaker of the present invention has an insulating nozzle disposed so as to cover an inner surface of a coupling member such that an end surface of the coupling member and an end surface of the insulating nozzle form one surface (the end surface of the coupling member is flush with the end surface of the insulating nozzle), in order to suppress contact between a high-temperature and high-pressure gas generated by an arc and the coupling member coupling the insulating nozzle and a driving rod.

8 Claims, 5 Drawing Sheets

GAS CIRCUIT BREAKER

CLAIM OF PRIORITY

The present application claims priority from Japanese Patent application serial no. 2018-45174, filed on Mar. 13, 2018, the content of which is hereby incorporated by reference into this application.

BACKGROUND OF THE INVENTION

1. Field of the Invention

The present invention relates to a gas circuit breaker, and particularly relates to a gas circuit breaker suitable as a puffer type circuit breaker utilizing a mechanical compression action, a heating and pressurizing action by arc heat, or the both the actions for current breaking.

2. Description of the Related Art

Gas circuit breakers are configured to break a short-circuit current caused by phase to phase short-circuit, a ground fault, or the like in an electric power systems, and conventionally, a puffer-type gas circuit breaker has been widely used.

In the puffer-type gas circuit breaker, an arc-extinguishing gas is mechanically compressed by a driving puffer cylinder directly connected to a driving-side arc contact so as to generate a high-pressure gas flow. Further, the gas flow is sprayed to an arc generated between the driving-side arc contact and a driven-side arc contact so as to break the current.

In general, the breaking performance of the gas circuit breaker depends on a pressure rise in a puffer chamber. Therefore, a gas circuit breaker combined with a thermal puffer which actively utilizes thermal energy of an arc to increase pressure in addition to a pressure rise caused by the conventional mechanical compression has been also widely used.

The gas circuit breaker combined with the thermal puffer forms spraying pressure of an arc-extinguishing gas utilizing thermal energy of an arc in addition to the pressure by mechanical compression, and can reduce operation energy required for a breaking operation as compared with the conventional method that utilizes the mechanical compression alone.

Further, systems to obtain the operation energy required for the breaking operation include a hydraulic system and a spring system. There are an increasing number of examples using a spring operation system that has advantages such as low cost and maintenance saving.

Further, a bidirectional drive system that drives an arc contact bidirectionally is also applied in order to enable a higher-speed electrode operation while maintaining operation energy.

In the bidirectional drive system, it is necessary to mechanically couple a driving part on an operating mechanism side, for example, an electrode fixed to an insulating nozzle or the like. For such a coupling portion, lightweight metal such as aluminum is used in many cases from the viewpoint of securing mechanical strength and weight reduction.

Meanwhile, since such a coupling portion is disposed in the vicinity of the insulating nozzle, there is a risk of being exposed to a high-temperature gas caused by an arc generated at the time of breaking a short-circuit current, so that a melting loss occurs and scattered metal particles get into the gaps among the arc contacts, thereby lowering breaking performance.

Against such a background, it is also conceivable to reduce a metal portion disposed at a distal end portion of the insulating nozzle so as to reduce opportunities for contacting with a high-temperature and high-pressure gas caused by the arc; however, a positional relationship between the arc contact and the metal portion becomes a restriction at the time of current breaking in some cases. Specifically, an electric field at a distal end of the arc contact becomes higher due to the reduction of the metal portion, resulting in a problem that the breaking performance and insulation performance deteriorate.

In this manner, what needs to be achieved is to improve the breaking performance in consideration of the positional relationship between the arc contact and the metal portion while protecting the coupling member against the high-temperature and high-pressure gas caused by the arc generated at the time of breaking the short-circuit current.

WO 2015/039918 A and JP 2003-109478 A can be cited as one of related art documents regarding protection of a metal member from a high-temperature and high-pressure gas in this manner.

WO 2015/039918 A describes a gas-insulated high-voltage circuit breaker including a first arc contact and a second arc contact at least one of which operates, an insulating nozzle, and a space which is surrounded by the insulating nozzle and allows an arc to be generated therein, in which ceramic coating is applied to a metal surface at a distal end portion of the insulating nozzle, in order to protect a metal member from a high-temperature and high-pressure gas.

Meanwhile, J P 2003-109478 A describes a circuit breaker in which a connection ring (coupling member) disposed at a distal end portion of an insulating nozzle and a coupling rod (driving rod) extending from the connection ring toward a counter electrode (driven-side arc contact) serve as coupling members to mechanically couple the insulating nozzle and a link mechanism (bidirectional drive mechanism). In the circuit breaker, the connection ring is disposed on an outer peripheral portion of the insulating nozzle drawn from a distal end of the insulating nozzle to the upstream side so as to prevent an arc-extinguishing gas, sprayed from the insulating nozzle to a space between a movable electrode (driving-side arc contact) and the counter electrode (driven-side arc contact), from directly hitting the connection ring.

SUMMARY OF THE INVENTION

In the gas circuit breaker described in WO 2015/039918 A described above, the metal portion disposed at the distal end portion of the insulating nozzle is protected by coating (ceramic coating) to prevent a melting loss of metal.

However, just protecting the metal portion disposed at the distal end portion of the insulating nozzle with the coating as described in WO 2015/039918 A may allow the coating to be consumed by the high-temperature gas caused by the arc while repeating the breaking of the short-circuit current, which may makes it is difficult to obtain the effect of protecting the metal.

On the other hand, in the circuit breaker described in JP 2003-109478 A described above, the connection ring is disposed at the outer peripheral portion of the insulating nozzle, drawn from the distal end of the insulating nozzle to the upstream side, such that the arc-extinguishing gas sprayed from the insulating nozzle to the space between the movable electrode and the counter electrode does not directly hit the connection ring.

However, just disposing the connection ring at the outer peripheral portion of the insulating nozzle drawn from the distal end of the insulating nozzle to the upstream side as described in JP 2003-109478 A may still cause a concern over whether the connection ring can be more efficiently protected from the high-temperature gas caused by the arc while repeating the breaking of the short-circuit current, which may makes it is difficult to the effect of improving the breaking performance while protecting the connection ring.

The present invention has been made in view of the above-described points, and an object thereof is to provide a gas circuit breaker capable of improving breaking performance while protecting a coupling member against a high-temperature and high-pressure gas caused by an arc generated at the time of breaking a short-circuit current or the like.

In order to attain the above object, the gas circuit breaker of the present invention includes: a filling container which is filled with an insulating gas having an arc-extinguishing property; a driving-side main conductor which is supported and fixed by an insulating support tube disposed inside the filling container, is connected to a driving-side lead-out conductor connected to an electric power system, and has an exhaust hole configured to exhaust the insulating gas whose temperature and pressure have been increased by an arc generated during breaking; an exhaust shaft which is provided inside the driving-side main conductor so as to be movable in an axial direction of the driving-side main conductor and has a shaft exhaust hole configured to exhaust the insulation gas whose temperature and pressure have been increased; an operating mechanism which is connected to the exhaust shaft and outputs an operating force in an axial direction of the exhaust shaft via an operation rod; a cylinder which is coaxially coupled to the exhaust shaft and is axially slidable on an inner peripheral surface of the driving-side main conductor; a puffer piston which is fixed inside the driving-side main conductor, has an opening in the axial direction of the driving-side main conductor, and allows the exhaust shaft to be slidable on an inner peripheral surface of the opening; a driving contact which is electrically connected to the cylinder and the driving-side lead-out conductor; and a driven contact which is electrically connected to a driven-side lead-out conductor and is connectable and disconnectable to and from the driving contact, the driven-side lead-out conductor being connected to the electric power system, wherein the driving contact has a driving-side main contact, an insulating nozzle, and a driving-side arc contact, the driven contact has a driven-side main contact and a driven-side arc contact, the driving-side arc contact is connected to the operating mechanism, the driven-side arc contact is coupled to a bidirectional drive mechanism section, and the bidirectional drive mechanism section includes a driving rod to receive a driving force from the driving-side main contact, a coupling member coupling the insulating nozzle and the driving rod, and a coupling mechanism to operate the driven-side arc contact in an opposite direction with respect to an operation of the driving rod. The insulating nozzle is disposed so as to cover an inner surface of the coupling member such that an end surface of the coupling member and an end surface of the insulating nozzle form one surface, in order to suppress contact between a high-temperature and high-pressure gas generated by the arc and the coupling member. Alternatively, a space is formed on an inner peripheral surface of the coupling member so as to face an outer peripheral surface of the insulating nozzle, and the insulating nozzle is disposed so as to cover the inner surface of the coupling member via the space.

According to the present invention, it is possible to improve the breaking performance while protecting the coupling member against the high-temperature and high-pressure gas generated by the arc generated at the time of breaking the short-circuit current or the like.

DESCRIPTION OF THE PREFERRED EMBODIMENTS

Figure 1:
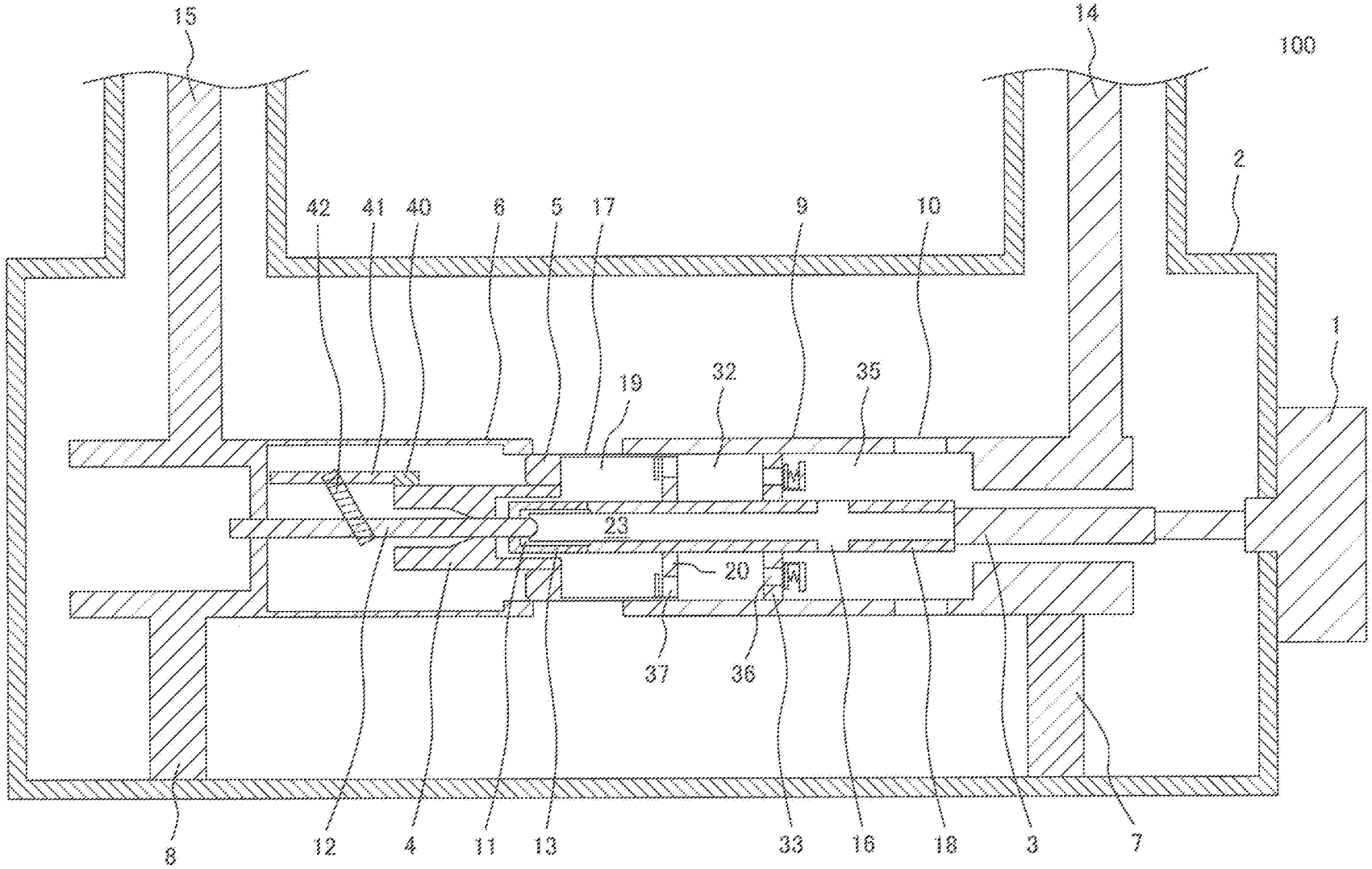
FIG. 1 is a cross-sectional view illustrating a schematic configuration of a gas circuit breaker according to a first embodiment of the present invention.

Hereinafter, a gas circuit breaker of the present invention will be described based on the illustrated embodiments. In each of the embodiments to be described hereinafter, the same reference numerals will be used for the same components. Further, an "axial direction" used herein means a direction of a central axis of a cylinder constituting a driving-side main conductor (the left-right (horizontal) direction in FIG. 1). In the case of using the "axial direction" in the following description, the phrase represents the meaning described above unless otherwise specified.

First Embodiment

Figure 2:
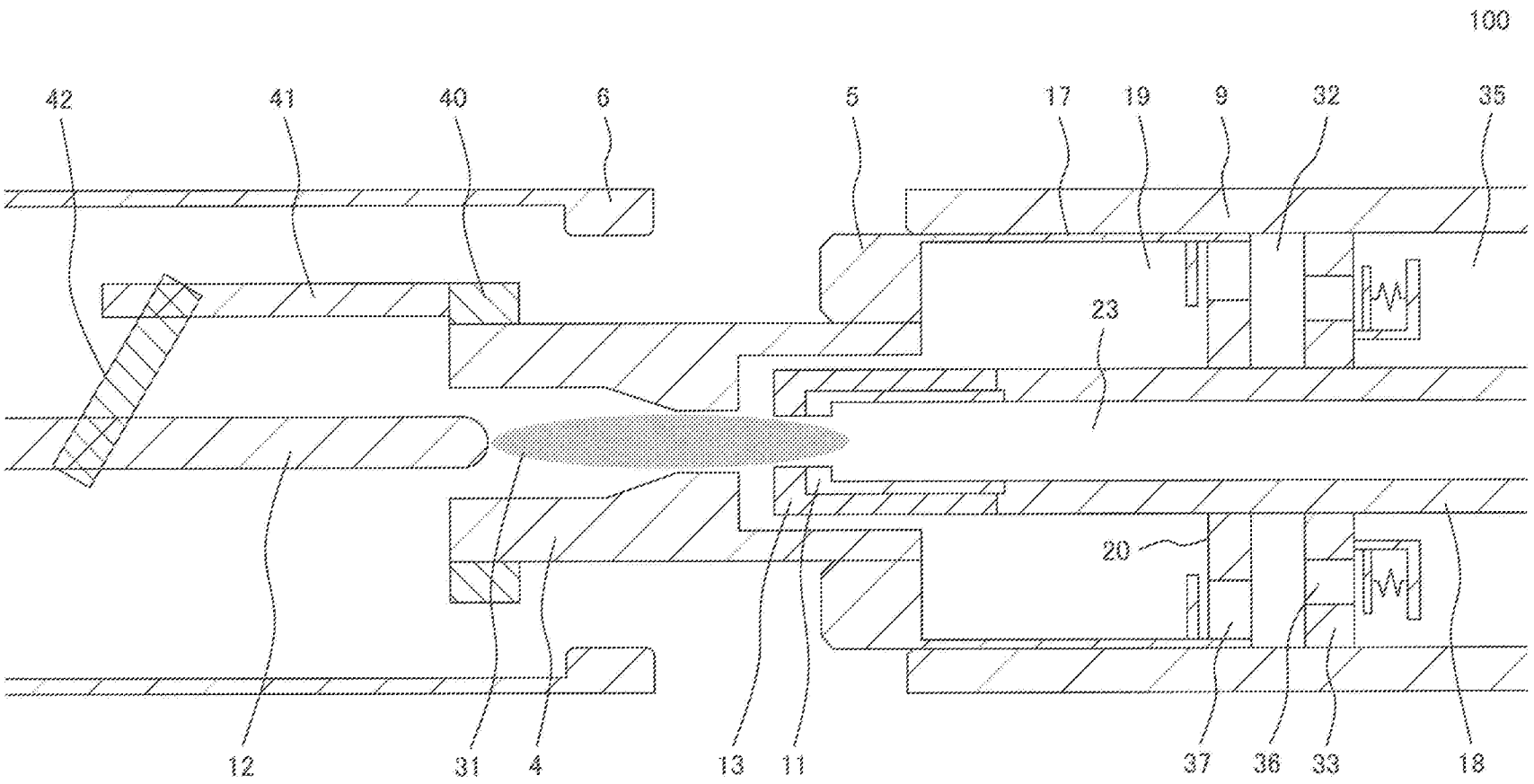
FIG. 2 is a cross-sectional view of the gas circuit breaker illustrating a flow of an insulating gas in an opened state of the gas circuit breaker according to the first embodiment of the present invention.

FIGS. 1 and 2 illustrate a schematic configuration of a first embodiment of a gas circuit breaker 100 of the present invention. FIG. 1 illustrates a closed state of the gas circuit breaker 100, and FIG. 2 illustrates an opened state of the gas circuit breaker 100.

The gas circuit breaker 100 of the present embodiment illustrated in FIGS. 1 and 2 is disposed in the middle of an electric power system (high-voltage circuit or the like) to stop energization of the electric power system by electrical disconnection in the electric power system when a short-circuit current occurs due to lightning or the like. The gas circuit breaker 100 illustrated in FIGS. 1 and 2 is an example of a puffer-type gas circuit breaker.

The gas circuit breaker 100 of the present embodiment illustrated in FIGS. 1 and 2 includes: a filling container 2 which is filled with an insulating gas having an arc-extinguishing property (for example, a sulfur hexafluoride gas); a driving-side main conductor 9 which is supported and fixed by an insulating support tube 7 disposed inside the filling container 2, is connected to a driving-side lead-out conductor 14 connected to the electric power system (high-voltage circuit), and has an exhaust hole 10 configured to exhaust the insulating gas whose temperature and pressure have been increased by an arc generated during breaking; an exhaust shaft 18 which is provided inside the driving-side main conductor 9 so as to be movable in an axial direction of the driving-side main conductor 9 and has a shaft exhaust hole 16 configured to exhaust the insulating gas whose temperature and pressure have been increased; an operating mechanism 1 which is connected to the exhaust shaft 18 and outputs an operating force in an axial direction of the exhaust shaft 18 via an operation rod 3; a cylinder 17 which is coaxially connected to the exhaust shaft 18 and is axially slidable on an inner peripheral surface of the driving-side main conductor 9; a puffer piston 33 which is fixed inside the driving-side main conductor 9 and has an opening in the axial direction of the driving-side main conductor 9, and allows the exhaust shaft 18 to be slidable on an inner peripheral surface of the opening; a driving-side main contact 5 which is electrically connected to the driving-side lead-out conductor 14 via the cylinder 17 and the driving-side main conductor 9; and a driven-side main contact 6 which is electrically connected to a driven-side lead-out conductor 15 connected to the electric power system and connectable and disconnectable to and from the driving-side main contact 5.

A driving contact includes the driving-side main contact 5, the insulating nozzle 4 and a driving-side arc contact 11, a driven contact includes the driven-side main contact 6 and a driven-side arc contact 12, the driving-side arc contact 11 is connected to the operating mechanism 1 via the exhaust shaft 18 and the operation rod 3, and the driven-side arc contact 12 is coupled to a bidirectional drive mechanism section (a driving rod 41 and a coupling mechanism 42 to be described below).

The bidirectional drive mechanism section includes: the driving rod 41 to receive a driving force as the driving rod 41 is coupled to the insulating nozzle 4 via a coupling member 40 made of, for example, aluminum and moving together with the insulating nozzle 4 operating together with the driving-side main contact 5; the coupling member 40 coupling the insulating nozzle 4 and the driving rod 41; and the coupling mechanism 42 to operate the driven-side arc contact 12 in an opposite direction with respect to the operation of the driving rod 41. In the present embodiment, the insulating nozzle 4 is disposed so as to cover an inner surface of the coupling member 40 such that an end surface 40*a* of the coupling member 40 and an end surface 4*a* of the insulating nozzle 4 form one surface, in order to suppress contact between a high-temperature and high-pressure gas generated by an arc and the coupling member 40, or a space 45 is formed on an inner peripheral surface of the coupling member 40 so as to face an outer peripheral surface of the insulating nozzle 4, and the insulating nozzle 4 is disposed so as to cover the inner surface of the coupling member 40 via the space 45 as will be described later.

More specifically, the gas circuit breaker 100 of the present embodiment includes the driving-side main conductor 9, the exhaust shaft 18, the cylinder 17, and the puffer piston 33, and these members are disposed inside the filling container 2 filled with the insulating gas having the arc-extinguishing property (for example, the sulfur hexafluoride gas). The driving-side main contact 5 and the driving-side arc contact 11 (the both are the driving side contacts) are provided on the front side of the exhaust shaft 18 (the left side in FIGS. 1 and 2). These members are electrically connected to the driving-side lead-out conductor 14 connected to the electric power system.

Further, the driven-side main contact 6 and the driven-side arc contact 12 (the both are the driven-side contacts), which are connectable and disconnectable to and from the driving-side main contact 5 and the driving-side arc contact 11, are electrically connected to the driven-side lead-out conductor 15 supported and fixed to a driven-side insulating tube 8 and connected to the electric power system.

Therefore, when a short-circuit current such as the above-described lightning occurs, the driving-side main contact 5 and the driving-side arc contact 11 are disconnected from the driven-side main contact 6 and the driven-side arc contact 12 to stop energization of the electric power system (this state is illustrated in FIG. 2).

The above-described driving-side main conductor 9 is supported and fixed by the insulating support tube 7 disposed inside the filling container 2. The driving-side main conductor 9 has a cylindrical shape, and the cylinder 17 is slidable in the inside thereof. Further, the exhaust hole 10 configured to exhaust a high-temperature, high-pressure insulating gas from the inside of the driving-side main conductor 9 to the inside of the filling container 2 is formed on a side surface of the driving-side main conductor 9. The high-temperature and high-pressure gas is generated when the insulating gas is heated and pressurized by the arc generated when the driving-side arc contact 11 is disconnected from the driven-side arc contact 12.

Further, the exhaust shaft 18 has a hollow shape provided inside the driving-side main conductor 9 coaxially with the driving-side main conductor 9, and a flow path 23 through which the high-temperature and high-pressure gas generated by the arc flows is formed inside the exhaust shaft 18. The shaft exhaust hole 16 configured to exhaust the high-temperature and high-pressure gas flowing through the flow path 23 to the outside of the exhaust shaft 18 is formed in a side surface on the rear side (the right side in FIGS. 1 and 2) of the exhaust shaft 18.

Further, the operating mechanism 1 for outputting the operating force in the axial direction of the exhaust shaft 18 is coupled to the exhaust shaft 18. In FIGS. 1 and 2, the operating mechanism 1 is coupled to the exhaust shaft 18 via the operation rod 3. When a short-circuit current occurs, a movement instruction from an output unit (not illustrated) is input to the operating mechanism 1.

Then, the operating mechanism 1 moves the exhaust shaft 18 to the rear side (the right side in FIGS. 1 and 2) via the operation rod 3 in response to the movement instruction from the output unit so that the driving-side main contact 5 and the driving-side arc contact 11 are disconnected from the driven-side main contact 6 and the driven-side arc contact 12 to break the electric power system (this state is illustrated in FIG. 2).

Further, the cylinder 17 is coupled to the exhaust shaft 18 to be coaxial with the exhaust shaft 18, and the cylinder 17 is slidable inside the cylindrical driving-side main conductor 9 along with the axial movement of the exhaust shaft 18.

Further, a piston 20 is disposed on the rear side (the right side in FIGS. 1 and 2) of the cylinder 17, and a mechanical puffer chamber 32 is formed between the piston 20 and the puffer piston 33, inside the driving-side main conductor 9. Therefore, the insulating gas inside the mechanical puffer chamber 32 is compressed as the cylinder 17 moves to the rear side together with the exhaust shaft 18.

Further, a thermal puffer chamber 19 is formed on the front side (the left side in FIGS. 1 and 2) of the piston 20, inside the cylinder 17. The high-temperature and high-pressure gas generated by the arc is guided to the thermal puffer chamber 19. The thermal puffer chamber 19, the mechanical puffer chamber 32, and a movable-side conductor inner peripheral space 35 communicate with each other in series in the order of the thermal puffer chamber 19, the mechanical puffer chamber 32, and the movable-side conductor inner peripheral space 35 through holes 36 and 37 formed so as to surround the exhaust shaft 18.

Further, the driving-side main contact 5 is disposed at a front (left in FIGS. 1 and 2) distal end of the cylinder 17, and the driving-side arc contact 11 is disposed at a front (left in FIGS. 1 and 2) distal end of the exhaust shaft 18 so as to be surrounded by the driving-side main contact 5. The driving-side arc contact 11 faces the inside of the exhaust shaft 18 (that is, the flow path 23), and the driving-side arc contact 11 is covered with a driving-side cover 13. The insulating nozzle 4 is disposed at the front (left in FIGS. 1 and 2) distal end of the cylinder 17 so as to surround the driving-side arc contact 11 and the driven-side arc contact 12.

Further, the puffer piston 33 has a disk shape fixed inside the driving-side main conductor 9 and has an opening in the vicinity of the center of the puffer piston 33 so that the exhaust shaft 18 is inserted into the opening.

As a result, the exhaust shaft 18 slides on the inner surface of the opening of the fixed puffer piston 33 to be movable in the axial direction.

Figure 3:
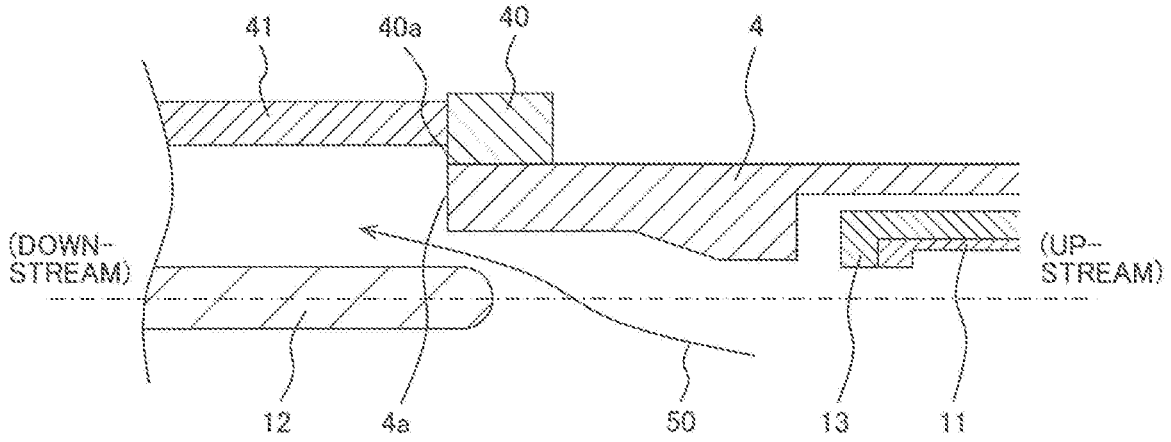
FIG. 3 is a partial cross-sectional view of the vicinity of a coupling member illustrating an opened state in the gas circuit breaker according to the first embodiment of the gas circuit breaker of the present invention.

FIG. 3 illustrates the vicinity of the coupling member 40 in the opened state of the gas circuit breaker 100 according to the present embodiment.

As illustrated in FIG. 3, in the gas circuit breaker 100 of the present embodiment, the insulating nozzle 4 is disposed so as to cover the inner surface of the coupling member 40 such that the end surface 40*a* of the coupling member 40 and the end surface 4*a* of the insulating nozzle 4 form one surface (the end surface 40*a* is flush with the end surface 4*a*), in order to suppress the contact between the high-temperature and high-pressure gas generated by the arc and the coupling member 40.

In the present embodiment, for example, the coupling member 40 and the insulating nozzle 4 are fixed as the inner peripheral surface of the coupling member 40 and the outer peripheral surface of the insulating nozzle 4 are fastened by a screw or the like.

Therefore, according to the present embodiment, a high-temperature and high-pressure gas 50 generated by the arc generated at the time of breaking the short-circuit current is discharged to the downstream side (the left side in FIG. 3) by the insulating nozzle 4, and it is possible to improve the breaking performance by preventing the contact between the coupling member 40 and the high-temperature and high-pressure gas 50.

Second Embodiment

Figure 4:
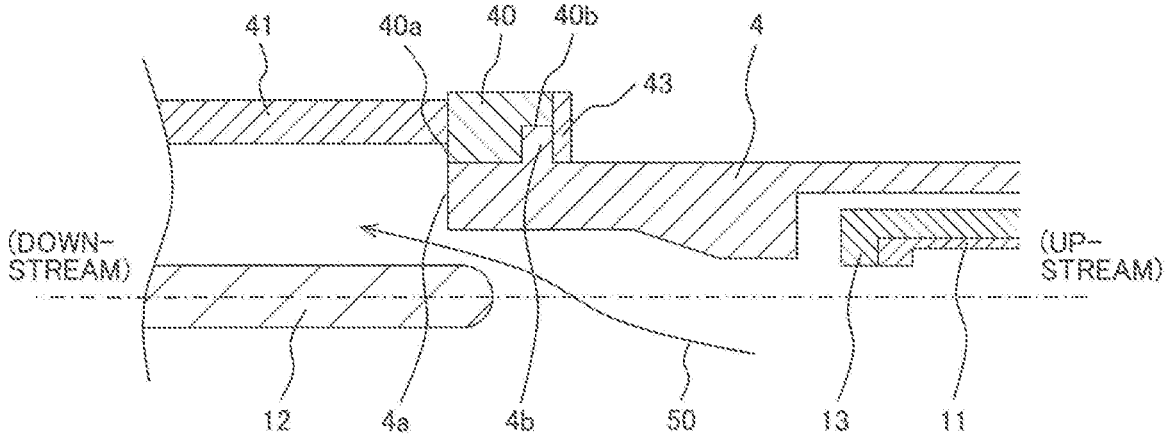
FIG. 4 is a partial cross-sectional view of the vicinity of a coupling member illustrating an opened state in a gas circuit breaker according to a second embodiment of the gas circuit breaker of the present invention.

FIG. 4 illustrates a second embodiment of the gas circuit breaker 100 of the present invention, and illustrates the vicinity of the coupling member 40 in the opened state of the gas circuit breaker 100.

The gas circuit breaker 100 of the present embodiment illustrated in FIG. 4 has substantially the same configurations as those of the first embodiment illustrated in FIG. 3. A difference from the first embodiment is that the insulating nozzle 4 and the coupling member 40 are coupled by engaging a coupling portion 4*b*, which is provided on and protruding from an outer periphery of the insulating nozzle 4, with a cutout portion 40*b* formed on an end surface opposite to the end surface 40*a* of the coupling member 40 and fixing an engagement portion 40*b* with a locking member (having a ring shape and made of aluminum) 43 from an axially outer side.

According to the present embodiment described above, it is a matter of course that the same effect as that of the first embodiment can be obtained, and it is possible to improve mechanical reliability of a fastening portion between the insulating nozzle 4 and the coupling member 40.

Third Embodiment

Figure 5:
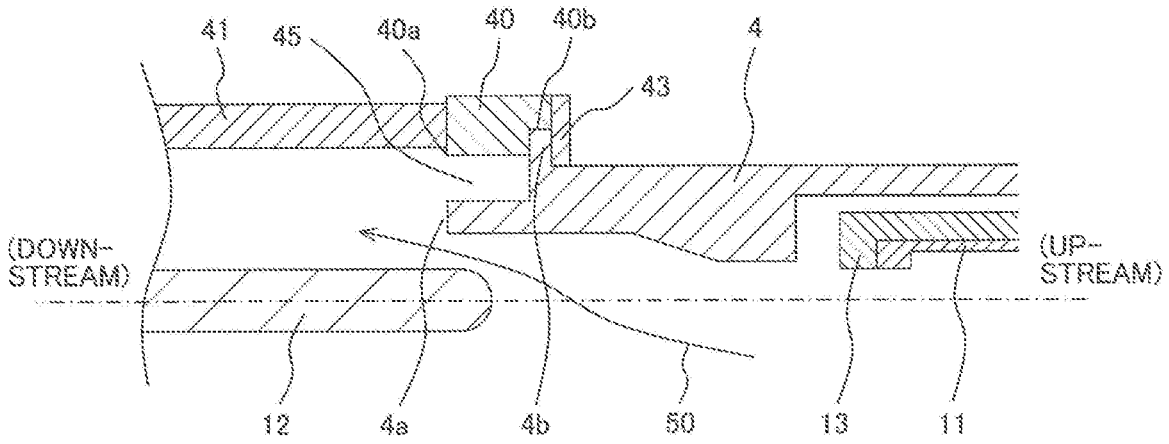
FIG. 5 is a partial cross-sectional view of the vicinity of a coupling member illustrating an opened state in a gas circuit breaker according to a third embodiment of the gas circuit breaker of the present invention.

FIG. 5 illustrates a third embodiment of the gas circuit breaker 100 of the present invention, and illustrates the vicinity of the coupling member 40 in the opened state of the gas circuit breaker 100.

The gas circuit breaker 100 of the present embodiment illustrated in FIG. 5 has substantially the same configurations as those of the second embodiment illustrated in FIG. 4. Differences from the second embodiment are that the insulating nozzle 4 and the coupling member 40 are coupled by engaging a coupling portion 4*b*, which is provided on and protruding from an outer periphery of the insulating nozzle 4, with a cutout portion 40*b* formed on an end surface opposite to the end surface 40*a* of the coupling member 40 and fixing an engagement portion 40*b* with a locking member (having a ring shape and made of aluminum) 43 from the axial direction, and that the space 45 is formed on the inner peripheral surface of the coupling member 40 so as to face the outer peripheral surface of the insulating nozzle 4.

According to the present embodiment described above, it is a matter of course that the same effects as those of the first and second embodiments can be obtained, and it is possible to reduce the weight of the distal end portion of the insulating nozzle 4.

Fourth Embodiment

Figure 6:
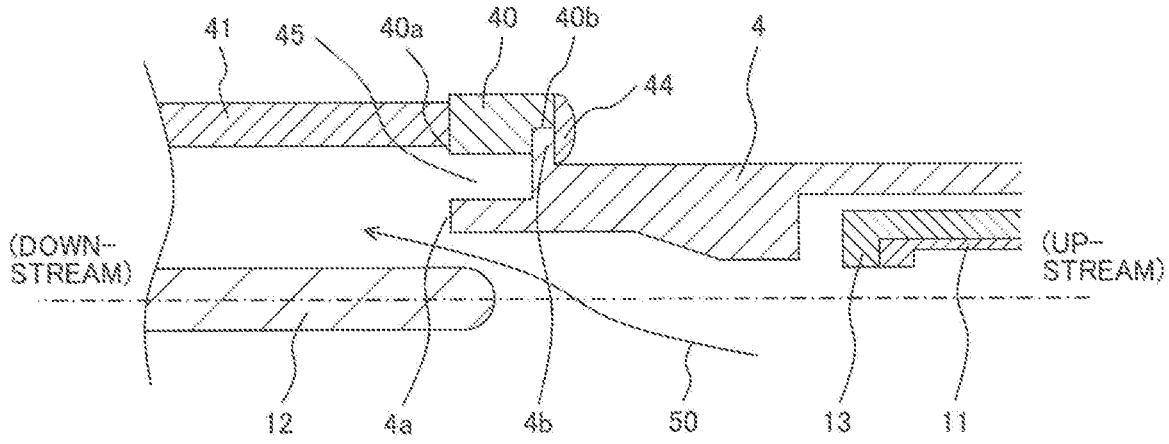
FIG. 6 is a partial cross-sectional view of the vicinity of a coupling member illustrating an opened state in a gas circuit breaker according to a fourth embodiment of the gas circuit breaker of the present invention.

FIG. 6 illustrates a fourth embodiment of the gas circuit breaker 100 of the present invention, and illustrates the vicinity of the coupling member 40 in the opened state of the gas circuit breaker 100.

The gas circuit breaker 100 of the present embodiment illustrated in FIG. 6 has substantially the same configurations as those of the third embodiment illustrated in FIG. 5. Differences from the third embodiment are that the insulating nozzle 4 and the coupling member 40 are fastened by an electric field relaxation ring 44 made of, for example, aluminum, instead of the locking member 43 and that a distal end portion of the driven-side arc contact 12 is positioned on the downstream side (the left side in FIG. 6) of the electric field relaxation ring 44.

According to the present embodiment described above, it is a matter of course that the same effects as those of the first, second, and third embodiments can be obtained, and it is possible to reduce an electric field at the distal end portion of the driven-side arc contact 12 by the electric field relaxation ring 44 and to improve the breaking performance.

Fifth Embodiment

Figure 7:
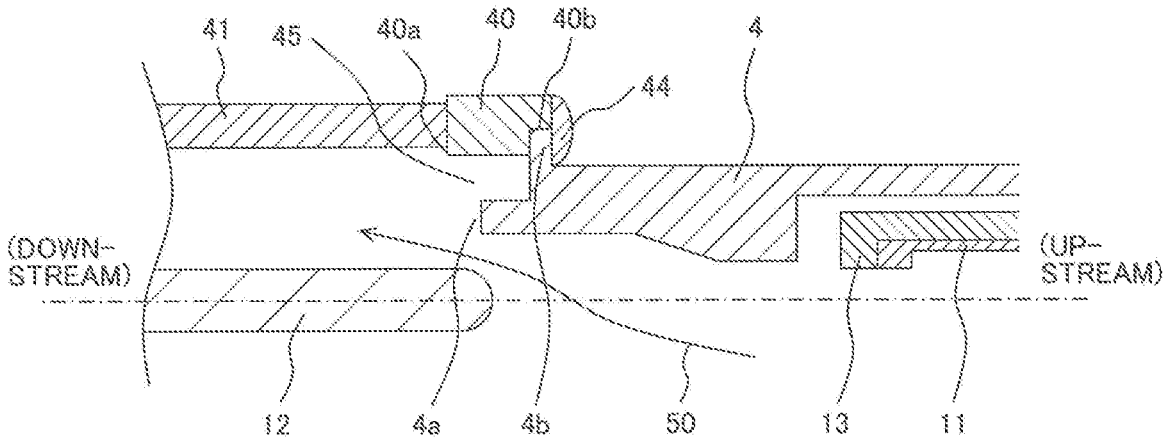
FIG. 7 is a partial cross-sectional view of the vicinity of a coupling member illustrating an opened state in a gas circuit breaker according to a fifth embodiment of the gas circuit breaker of the present invention.

FIG. 7 illustrates a fifth embodiment of the gas circuit breaker 100 of the present invention, and illustrates the vicinity of the coupling member 40 in the opened state of the gas circuit breaker 100.

The gas circuit breaker 100 of the present embodiment illustrated in FIG. 7 has substantially the same configurations as those of the fourth embodiment illustrated in FIG. 6. A difference from the fourth embodiment is that the end surface 4*a* of the insulating nozzle 4 is positioned on the upstream side (the right direction in FIG. 7) with respect to the end surface 40*a* of the coupling member 40.

According to the present embodiment described above, it is a matter of course that the same effects as those of the first and second embodiments can be obtained, and it is possible to reduce the weight of the distal end portion of the insulating nozzle 4.

Sixth Embodiment

Figure 8:
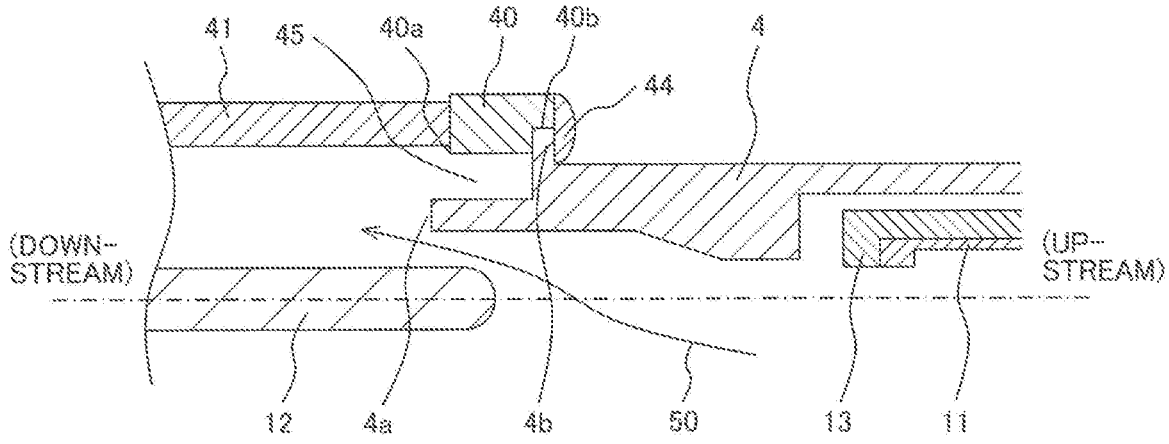
FIG. 8 is a partial cross-sectional view of the vicinity of a coupling member illustrating an opened state in a gas circuit breaker according to a sixth embodiment of the gas circuit breaker of the present invention.

FIG. 8 illustrates a sixth embodiment of the gas circuit breaker 100 of the present invention, and illustrates the vicinity of the coupling member 40 in the opened state of the gas circuit breaker 100.

The gas circuit breaker 100 of the present embodiment illustrated in FIG. 8 has substantially the same configurations as those of the fourth embodiment illustrated in FIG. 6. A difference from the fourth embodiment is that the end surface 4*a* of the insulating nozzle 4 is positioned on the downstream side (the left direction in FIG. 8) with respect to the end surface 40*a* of the coupling member 40.

According to the present embodiment described above, it is a matter of course that the same effects as those of the first and second embodiments can be obtained, and it is possible to guide the high-temperature and high-pressure gas 50 to the further downstream side of the distal end portion 4*a* of the insulating nozzle 4 and to efficiently protect the coupling member 40.

Incidentally, the present invention is not limited to the above-described embodiments and includes various modifications. For example, the above-described embodiments have been described in detail in order to describe the present invention in an easily understandable manner, and are not necessarily limited to one including the entire configuration that has been described above. Further, some configurations of a certain embodiment can be substituted by configurations of another embodiment, and further, a configuration of another embodiment can be also added to a configuration of a certain embodiment. Further, addition, deletion, or substitution of other configurations can be made with respect to some configurations of each embodiment.

What is claimed is:

1. A gas circuit breaker comprising:

a filling container which is filled with an insulating gas having an arc-extinguishing property;

a driving-side main conductor which is supported and fixed by an insulating support tube disposed inside the filling container, and is connected to a driving-side lead-out conductor connected to an electric power system, and has an exhaust hole configured to exhaust the insulating gas whose temperature and pressure have been increased by an arc generated during breaking;

an exhaust shaft which is provided inside the driving-side main conductor so as to be movable in an axial direction of the driving-side main conductor and has a shaft exhaust hole configured to exhaust the insulation gas whose temperature and pressure have been increased;

an operating mechanism which is connected to the exhaust shaft and outputs an operating force in an axial direction of the exhaust shaft via an operation rod;

a cylinder which is coaxially coupled to the exhaust shaft and is axially slidable on an inner peripheral surface of the driving-side main conductor;

a puffer piston which is fixed inside the driving-side main conductor, and has an opening in the axial direction of the driving-side main conductor, and allows the exhaust shaft to be slidable on an inner peripheral surface of the opening;

a driving contact which is electrically connected to the cylinder and the driving-side lead-out conductor; and a driven contact which is electrically connected to a driven-side lead-out conductor and is connectable and disconnectable to and from the driving contact, the driven-side lead-out conductor being connected to the electric power system, wherein:

the driving contact has a driving-side main contact, an insulating nozzle, and a driving-side arc contact, the driven contact has a driven-side main contact and a driven-side arc contact, the driving-side arc contact is connected to the operating mechanism, the driven-side arc contact is coupled to a bidirectional drive mechanism section, the bidirectional drive mechanism section includes a driving rod to receive a driving force from the driving-side main contact, a coupling member coupling the insulating nozzle and the driving rod, and a coupling mechanism to operate the driven-side arc contact in an opposite direction with respect to an operation of the driving rod, the insulating nozzle is disposed so as to cover an inner surface of the coupling member such that an end surface of the coupling member and an end surface of the insulating nozzle form one surface, in order to suppress contact between a high-temperature and high-pressure gas generated by the arc and the coupling member, and the insulating nozzle and the coupling member are coupled by engaging a nozzle coupling portion, which is provided on and protruding from an outer periphery of the insulating nozzle, with a cutout portion formed on an end surface opposite to the end surface of the coupling member and by fixing an engagement portion therebetween with a locking member from an axial direction.

2. The gas circuit breaker according to claim 1, wherein a space is formed on an inner peripheral surface of the coupling member so as to face an outer peripheral surface of the insulating nozzle.

3. A gas circuit breaker comprising:

a filling container which is filled with an insulating gas having an arc-extinguishing property;

a driving-side main conductor which is supported and fixed by an insulating support tube disposed inside the filling container, and is connected to a driving-side lead-out conductor connected to an electric power system, and has an exhaust hole configured to exhaust the insulating gas whose temperature and pressure have been increased by an arc generated during breaking;

an exhaust shaft which is provided inside the driving-side main conductor so as to be movable in an axial direction of the driving-side main conductor and has a shaft exhaust hole configured to exhaust the insulation gas whose temperature and pressure have been increased;

an operating mechanism which is connected to the exhaust shaft and outputs an operating force in an axial direction of the exhaust shaft via an operation rod;

a cylinder which is coaxially coupled to the exhaust shaft and is axially slidable on an inner peripheral surface of the driving-side main conductor;

a puffer piston which is fixed inside the driving-side main conductor, and has an opening in the axial direction of the driving-side main conductor, and allows the exhaust shaft to be slidable on an inner peripheral surface of the opening;

a driving contact which is electrically connected to the cylinder and the driving-side lead-out conductor; and a driven contact which is electrically connected to a driven-side lead-out conductor and is connectable and disconnectable to and from the driving contact, the driven-side lead-out conductor being connected to the electric power system, wherein:

the driving contact has a driving-side main contact, an insulating nozzle, and a driving-side arc contact, the driven contact has a driven-side main contact and a driven-side arc contact, the driving-side arc contact is connected to the operating mechanism, the driven-side arc contact is coupled to a bidirectional drive mechanism section, the bidirectional drive mechanism section includes a driving rod to receive a driving force from the driving-side main contact, a coupling member coupling the insulating nozzle and the driving rod, and a coupling mechanism to operate the driven-side arc contact in an opposite direction with respect to an operation of the driving rod, the insulating nozzle is disposed so as to cover an inner surface of the coupling member such that an end surface of the coupling member and an end surface of the insulating nozzle form one surface, in order to suppress contact between a high-temperature and high-pressure gas generated by the arc and the coupling member, the insulating nozzle and the coupling member are coupled by engaging a nozzle coupling portion, which is provided on and protruding from an outer periphery of the insulating nozzle, with a cutout portion formed on an end surface opposite to the end surface of the coupling member and by fixing an engagement portion therebetween with an electric field relaxation ring from an axially outer side, and a space is formed on an inner peripheral surface of the coupling member so as to face an outer peripheral surface of the insulating nozzle.

4. The gas circuit breaker according to claim 3, wherein a distal end portion of the driven-side arc contact is positioned on a downstream side of the electric field relaxation ring during current breaking by the gas circuit breaker.

5. A gas circuit breaker comprising:

a filling container which is filled with an insulating gas having an arc-extinguishing property;

a driving-side main conductor which is supported and fixed by an insulating support tube disposed inside the filling container, and is connected to a driving-side lead-out conductor connected to an electric power system, and has an exhaust hole configured to exhaust the insulating gas whose temperature and pressure have been increased by an arc generated during breaking;

an exhaust shaft which is provided inside the driving-side main conductor so as to be movable in an axial direction of the driving-side main conductor and has a shaft exhaust hole configured to exhaust the insulation gas whose temperature and pressure have been increased;

an operating mechanism which is connected to the exhaust shaft and outputs an operating force in an axial direction of the exhaust shaft via an operation rod;

a cylinder which is coaxially coupled to the exhaust shaft and is axially slidable on an inner peripheral surface of the driving-side main conductor;

a puffer piston which is fixed inside the driving-side main conductor, has an opening in the axial direction of the driving-side main conductor, and allows the exhaust shaft to be slidable on an inner peripheral surface of the opening;

a driving contact which is electrically connected to the cylinder and the driving-side lead-out conductor; and a driven contact which is electrically connected to a driven-side lead-out conductor and is connectable and disconnectable to and from the driving contact, the driven-side lead-out conductor being connected to the electric power system, wherein:

the driving contact has a driving-side main contact, an insulating nozzle, and a driving-side arc contact, the driven contact has a driven-side main contact and a driven-side arc contact, the driving-side arc contact is connected to the operating mechanism, the driven-side arc contact is coupled to a bidirectional drive mechanism section, the bidirectional drive mechanism section includes a driving rod to receive a driving force from the driving-side main contact, a coupling member coupling the insulating nozzle and the driving rod, and a coupling mechanism to operate the driven-side arc contact in an opposite direction with respect to an operation of the driving rod, a space is formed on an inner peripheral surface of the coupling member so as to face an outer peripheral surface of the insulating nozzle, the insulating nozzle is disposed so as to cover an inner surface of the coupling member via the space, and the insulating nozzle and the coupling member are coupled by engaging a nozzle coupling portion, which is provided on and protruding from an outer periphery of the insulating nozzle, with a cutout portion formed on an end surface opposite to the end surface of the coupling member and by fixing an engagement portion therebetween with a locking member from an axial direction.

6. A qas circuit breaker comprising:

a filling container which is filled with an insulating qas having an arc-extinguishing property;

a driving-side main conductor which is supported and fixed by an insulating support tube disposed inside the filling container, and is connected to a driving-side lead-out conductor connected to an electric power system, and has an exhaust hole configured to exhaust the insulating gas whose temperature and pressure have been increased by an arc generated during breaking;

an exhaust shaft which is provided inside the driving-side main conductor so as to be movable in an axial direction of the driving-side main conductor and has a shaft exhaust hole configured to exhaust the insulation gas whose temperature and pressure have been increased;

an operating mechanism which is connected to the exhaust shaft and outputs an operating force in an axial direction of the exhaust shaft via an operation rod;

a cylinder which is coaxially coupled to the exhaust shaft and is axially slidable on an inner peripheral surface of the driving-side main conductor;

a puffer piston which is fixed inside the driving-side main conductor, has an opening in the axial direction of the driving-side main conductor, and allows the exhaust shaft to be slidable on an inner peripheral surface of the opening;

a driving contact which is electrically connected to the cylinder and the driving-side lead-out conductor; and a driven contact which is electrically connected to a driven-side lead-out conductor and is connectable and disconnectable to and from the driving contact, the driven-side lead-out conductor being connected to the electric power system, wherein:

the driving contact has a driving-side main contact, an insulating nozzle, and a driving-side arc contact, the driven contact has a driven-side main contact and a driven-side arc contact, the driving-side arc contact is connected to the operating mechanism, the driven-side arc contact is coupled to a bidirectional drive mechanism section, the bidirectional drive mechanism section includes a driving rod to receive a driving force from the driving-side main contact, a coupling member coupling the insulating nozzle and the driving rod, and a coupling mechanism to operate the driven-side arc contact in an opposite direction with respect to an operation of the driving rod, a space is formed on an inner peripheral surface of the coupling member so as to face an outer peripheral surface of the insulating nozzle, the insulating nozzle is disposed so as to cover an inner surface of the coupling member via the space, and the insulating nozzle and the coupling member are coupled by engaging a nozzle coupling portion, which is provided on and protruding from an outer periphery of the insulating nozzle, with a cutout portion formed on an end surface opposite to the end surface of the coupling member and by fixing an engagement portion therebetween with an electric field relaxation ring from an axially outer side.

7. The gas circuit breaker according to claim 6, wherein an end surface of the insulating nozzle is positioned on an upstream side with respect to the end surface of the coupling member.

8. The gas circuit breaker according to claim 6, wherein an end surface of the insulating nozzle is positioned on a downstream side with respect to the end surface of the coupling member.

* * * * *